US009488007B2

(12) United States Patent
Harrington et al.

(10) Patent No.: US 9,488,007 B2
(45) Date of Patent: Nov. 8, 2016

(54) WEAR RESISTANT PLATES ON A LEADING TRANSITIONAL SURFACE OF THE LEG FOR A ROTARY CONE DRILL BIT

(71) Applicant: Varel International Ind., L.P., Carrollton, TX (US)

(72) Inventors: David Michel Harrington, Dallas, TX (US); Amnach Kongamnach, Lavon, TX (US); Cesar A. Fierro, Lewisville, TX (US)

(73) Assignee: VAREL INTERNATIONAL IND., L.P., Carrollton, TX (US)

( * ) Notice: Subject to any disclaimer, the term of this patent is extended or adjusted under 35 U.S.C. 154(b) by 227 days.

(21) Appl. No.: 14/193,970

(22) Filed: Feb. 28, 2014

(65) Prior Publication Data

US 2014/0299384 A1 Oct. 9, 2014

Related U.S. Application Data

(60) Provisional application No. 61/808,565, filed on Apr. 4, 2013.

(51) Int. Cl.
*E21B 10/50* (2006.01)
*E21B 10/08* (2006.01)

(52) U.S. Cl.
CPC ..... *E21B 10/08* (2013.01)

(58) Field of Classification Search
CPC ..... E21B 10/50; E21B 10/52; E21B 10/46
See application file for complete search history.

(56) References Cited

U.S. PATENT DOCUMENTS

| | | | | |
|---|---|---|---|---|
| 3,389,761 | A | 6/1968 | Ott | |
| 3,461,983 | A | 8/1969 | Hudson et al. | |
| 4,421,184 | A | 12/1983 | Mullins | |
| 4,531,595 | A | 7/1985 | Housman | |
| 4,591,008 | A | 5/1986 | Oliver | |
| 5,074,367 | A | 12/1991 | Estes | |
| 5,145,016 | A | 9/1992 | Estes | |
| 5,289,889 | A | 3/1994 | Gearhart et al. | |
| 5,415,243 | A | 5/1995 | Lyon et al. | |
| 5,494,123 | A | 2/1996 | Nguyen | |
| 5,570,750 | A | 11/1996 | Williams | |
| 5,595,255 | A | 1/1997 | Huffstutler | |
| 5,644,956 | A | 7/1997 | Blackman et al. | |
| 5,709,278 | A | 1/1998 | Crawford | |
| 5,890,550 | A * | 4/1999 | Swadi | E21B 10/52 175/374 |
| 5,975,223 | A | 11/1999 | Karlsson | |
| 6,116,357 | A | 9/2000 | Wagoner et al. | |
| 6,296,067 | B1 | 10/2001 | Slaughter, Jr. et al. | |
| 6,336,512 | B1 | 1/2002 | Siracki et al. | |
| 6,446,739 | B1 | 9/2002 | Richman et al. | |

(Continued)

OTHER PUBLICATIONS

International Search Report and Written Opinion for PCT/US2011/052714 mailed Jan. 9, 2012 (8 pages).

(Continued)

*Primary Examiner* — Jennifer H Gay

(57) ABSTRACT

A rotary cone drill bit includes: a body, a leg depending from the body, a bearing shaft extending from the leg and a cone mounted to the bearing shaft. The leg includes a leading transitional surface. A bottom surface of a hard material plate is attached to a substantially conforming surface of the leg in a position where the hard material plate is disposed on a floor surface formed in or by the leading transitional surface of the leg.

22 Claims, 9 Drawing Sheets

(56) References Cited

U.S. PATENT DOCUMENTS

| | | | | |
|---|---|---|---|---|
| 6,450,270 | B1 | 9/2002 | Saxton | |
| 6,575,350 | B2 | 6/2003 | Evans et al. | |
| 6,607,047 | B1 * | 8/2003 | Swadi | E21B 10/16 175/374 |
| 6,619,412 | B2 | 9/2003 | Slaughter, Jr. et al. | |
| 6,688,410 | B1 | 2/2004 | Singh et al. | |
| 6,955,233 | B2 | 10/2005 | Crowe et al. | |
| 7,182,162 | B2 * | 2/2007 | Beuershausen | E21B 10/08 175/374 |
| 7,350,600 | B2 | 4/2008 | Beuershausen et al. | |
| 7,484,577 | B2 | 2/2009 | Overstreet et al. | |
| 7,621,347 | B2 | 11/2009 | Overstreet | |
| 7,845,437 | B2 * | 12/2010 | Bielawa | E21B 10/28 175/357 |
| 8,096,373 | B2 | 1/2012 | Patel et al. | |
| 8,522,899 | B2 * | 9/2013 | Bouaphanh | E21B 10/50 175/374 |
| 8,528,667 | B2 * | 9/2013 | Bouaphanh | E21B 10/50 175/374 |
| 8,534,390 | B2 * | 9/2013 | Bouaphanh | E21B 10/50 175/374 |
| 2002/0035895 | A1 | 3/2002 | Davies et al. | |
| 2004/0173384 | A1 | 9/2004 | Yong et al. | |
| 2006/0021800 | A1 * | 2/2006 | Beuershausen | E21B 10/08 175/374 |
| 2006/0213692 | A1 | 9/2006 | Singh et al. | |
| 2007/0163812 | A1 | 7/2007 | Overstreet et al. | |
| 2008/0202817 | A1 | 8/2008 | Massey et al. | |
| 2009/0032572 | A1 | 2/2009 | Oxfdord et al. | |
| 2009/0038442 | A1 | 2/2009 | Shamburger et al. | |
| 2010/0071961 | A1 | 3/2010 | Steel et al. | |
| 2010/0101866 | A1 | 4/2010 | Bird | |
| 2010/0224418 | A1 | 9/2010 | Eason et al. | |
| 2012/0080236 | A1 * | 4/2012 | Bouaphanh | E21B 10/50 175/374 |
| 2012/0080237 | A1 * | 4/2012 | Bouaphanh | E21B 10/50 175/374 |
| 2012/0080238 | A1 * | 4/2012 | Bouaphanh | E21B 10/50 175/374 |
| 2014/0299384 | A1 * | 10/2014 | Harrington | E21B 10/08 175/374 |

OTHER PUBLICATIONS

International Search Report and Written Opinion for PCT/US2011/054132 mailed Mar. 26, 2012 (8 pages).

International Search Report and Written Opinion for PCT/US2014/020632 mailed Jun. 19, 2014 (14 pages).

* cited by examiner

WEAR RESISTANT PLATES ON A LEADING TRANSITIONAL SURFACE OF THE LEG FOR A ROTARY CONE DRILL BIT

PRIORITY CLAIM

The present application claims priority to U.S. Provisional Application for Patent No. 61/808,565, filed Apr. 4, 2013, and entitled Wear Resistant Plates on a Leading Transitional Surface of the Leg for a Rotary Cone Drill Bit, which is hereby incorporated by reference.

CROSS-REFERENCE TO RELATED APPLICATION

The present application is related to U.S. patent application Ser. No. 13/156,458 filed Jun. 9, 2011, entitled "Wear Resistant Material at the Leading Edge of the Leg for a Rotary Cone Drill Bit," now U.S. Pat. No. 8,528,667; U.S. patent application Ser. No. 12/896,406 filed Oct. 1, 2010 entitled "Wear Resistant Material at the Shirttail Edge and Leading Edge of a Rotary Cone Drill Bit," now U.S. Pat. No. 8,522,899; and U.S. patent application Ser. No. 12/896,484 filed Oct. 1, 2010, entitled "Wear Resistant Material for the Shirttail Outer Surface of a Rotary Cone Drill Bit," now U.S. Pat. No. 8,534,390, the disclosures of each of which are hereby incorporated by reference to the maximum extent allowable by law.

BACKGROUND

1. Technical Field of the Invention

The present invention relates to earth boring bits, and more particularly to those having rotatable cutters, also known as rotary cone drill bits.

2. Description of Related Art

Reference is made to FIGS. 1 and 2, wherein FIG. 1 illustrates an isometric view of a prior art rotary cone drill bit 10, and FIG. 2 illustrates a cross-sectional view of a portion of the prior art rotary cone drill bit 10 of FIG. 1. A leg 12 depends from a body portion 14 of the drill bit 10. The leg 12 includes a bearing shaft 16 which extends in a downward and radial inward direction. The bearing shaft 16 includes a cylindrical bearing surface 18. A cutter cone 20 is mounted to the bearing shaft 16 and supported for rotation by the bearing surface 18. In an alternative implementation, the cutter cone 20 is supported for rotation on the bearing shaft 16 by a set of roller bearings. The shape and configuration of the cone 20, as well its rotatable attachment to the bearing shaft 16, is well known in the art. In sealed bearing implementations, the bearing (journal or roller) between the cone 20 and bearing shaft 16 is lubricated by a lubricant (such as a grease) that fills regions adjacent to the bearing as well as other passages 21 in the rotary cone drill bit in a manner well known by those skilled in the art. This lubricant is retained within the rotary cone drill bit through the use of, for example, a resilient seal in the form of an o-ring 22 positioned in a seal gland 24 between the inner cylindrical surface 26 near the base of the cone 20 and the outer cylindrical surface 28 near the base of the bearing shaft 16. The lubrication system further includes a pressure compensation assembly 27 installed within an opening 29 formed in an upper shoulder surface 25 of the leg 12. The opening 29 is coupled to the passage 21. FIGS. 1 and 2 illustrate an implementation wherein the opening 29 is formed exclusively in the shoulder surface 25. It will be understood, however, that the opening 29 may be formed partially in the shoulder surface 25 and partially in the outer (gage or shirttail) surface 30 of the leg 12 (below shoulder surface 25). Still further, the opening 29 may be formed in the outer surface 30 of the leg.

The outer surface 30 of the leg 12 terminates at a semicircular edge 32 proximal to the cone 20. The region of the leg 12 associated with the surface 30 is known in the art as the "shirttail region," and the edge 32 is known in the art as the "shirttail edge." The shirttail edge 32 is provided where the terminal portion of the outer gage or shirttail surface 30 transitions to an inside radial surface 34 oriented parallel to the base of the cone 20 (and perpendicular to the bearing shaft 16) and positioned at the base of the bearing shaft 16.

The outer surface 30 of the leg 12 (below shoulder surface 25) in the shirttail region laterally terminates at a leading shirttail edge 50 and a trailing shirttail edge 52. The leading shirttail edge 50 is especially susceptible to wear during operation of the rotary cone drill bit 10. The prior art teaches two methods for delaying wear of the leading shirttail edge 50. FIG. 3 illustrates a first method in which a layer of welded hardfacing material 40 is applied to the surface 30 extending along at least a portion of the leading shirttail edge 50. The hardfacing material is typically a deposit of tungsten carbide hardmetal 40. The material is typically pelletized tungsten carbide carried in a nickel welding medium. This solution does not work well when the rotary cone drill bit is run in a highly abrasive rock formation because the hardfacing material 40 wears down too quickly. It is primarily the welding medium, typically nickel, which accounts for the relative poor performance of the weld on material. FIG. 4 illustrates a second method in which tungsten carbide inserts 42 are press-fit into holes 44 formed in the surface 30 near the leading shirttail edge 50. While these inserts 42 provide better abrasion resistance (in comparison to the use of hardfacing material), the inserts 42 do not provide protection for the leading shirttail edge 50. The reason for this is that the holes 44 must be located at some appreciable distance from the leading shirttail edge 50 in order for the press-fit to function properly and peripherally retain the inserts 42. For example, a separation d2 of at least 0.125 inches is typically provided from the edge of the hole 44 to the leading edge 50. Thus, the method of FIG. 4 functions to primarily protect the shirttail region near to, but not exactly at, the leading shirttail edge 50. Furthermore, in order to be suitably retained, the press-fit inserts 42 must typically have a thickness t (with a corresponding depth of the hole 44) such that a ratio of the thickness of the insert to a diameter d' of the insert (where the inserts are round) or width w of the insert (with other shapes) exceeds about 0.5 (i.e., $t/d' \geq 0.5$; or $t/w \geq 0.5$).

Although not explicitly shown in FIGS. 3 and 4, the protection mechanisms shown could alternatively, or additionally, be provided on the leading side surface 54 of the leg 12. This leading side surface 54 is adjacent the outer surface 30 of the leg 12 at the leading shirttail edge 50.

With reference once again to FIGS. 1 and 2, the shoulder surface 25 of the leg 12 laterally terminates at a leading shoulder edge 51 and a trailing shoulder edge 53. The leading shoulder edge 51 is also susceptible to wear during operation of the rotary cone drill bit 10, more specifically when the bit 10 is being removed from the drill hole. This is because the shoulder edge 51 may have to function in a cutting-like or abrasive manner to remove formation materials in instances where the drilled hole has narrowed. The leading shoulder edge 51 and shoulder surface 25 are further susceptible to damage from formation material falling in the drill hole and having to be removed. Wear of the leading shoulder edge 51 and shoulder surface 25 can have adverse effects on the opening 29 and the pressure compensation assembly 27 installed within that opening 29 that perhaps lead to premature failure of the lubrication system.

SUMMARY

In an embodiment, a rotary cone drill bit comprises: a body, a leg depending from the body, a bearing shaft extending from the leg and a cone mounted to the bearing shaft. The leg includes a leading transitional surface. A bottom surface of a hard material plate is attached to a substantially conforming surface of the leg in a position where the hard material plate is disposed on a floor surface formed in or by the leading transitional surface of the leg.

In any of the foregoing embodiments, a material for attaching the hard material plate may comprise a flowable adhesive material interposed between the bottom surface of the hard material plate to the floor surface of the leg. That material may comprise, for example, a brazing material.

In any of the foregoing embodiments, the hard material plate may comprise polycrystalline diamond compact, or be made of a material such as solid tungsten carbide, or comprise a polycrystalline diamond compact, a cubic boron nitride compact, an impregnated diamond segment, or a ceramic segment.

BRIEF DESCRIPTION OF THE DRAWINGS

Other features and advantages of the invention will become clear in the description which follows of several non-limiting examples, with references to the attached drawings wherein.

DETAILED DESCRIPTION OF THE DRAWINGS

Figure 1:
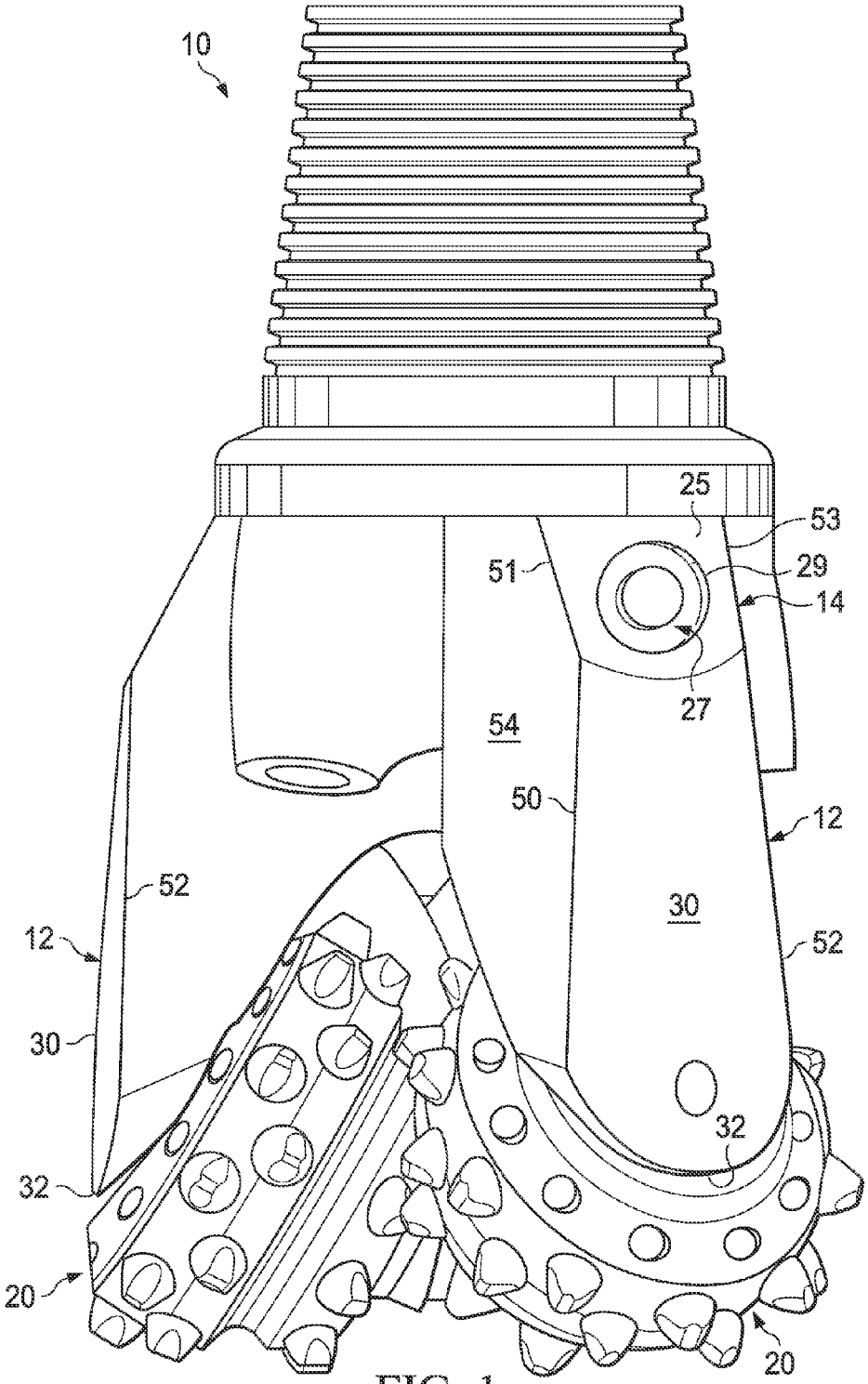
FIG. 1 (PRIOR ART)
FIG. 1 illustrates an isometric view of a prior art rotary cone drill bit.
Figure 2:
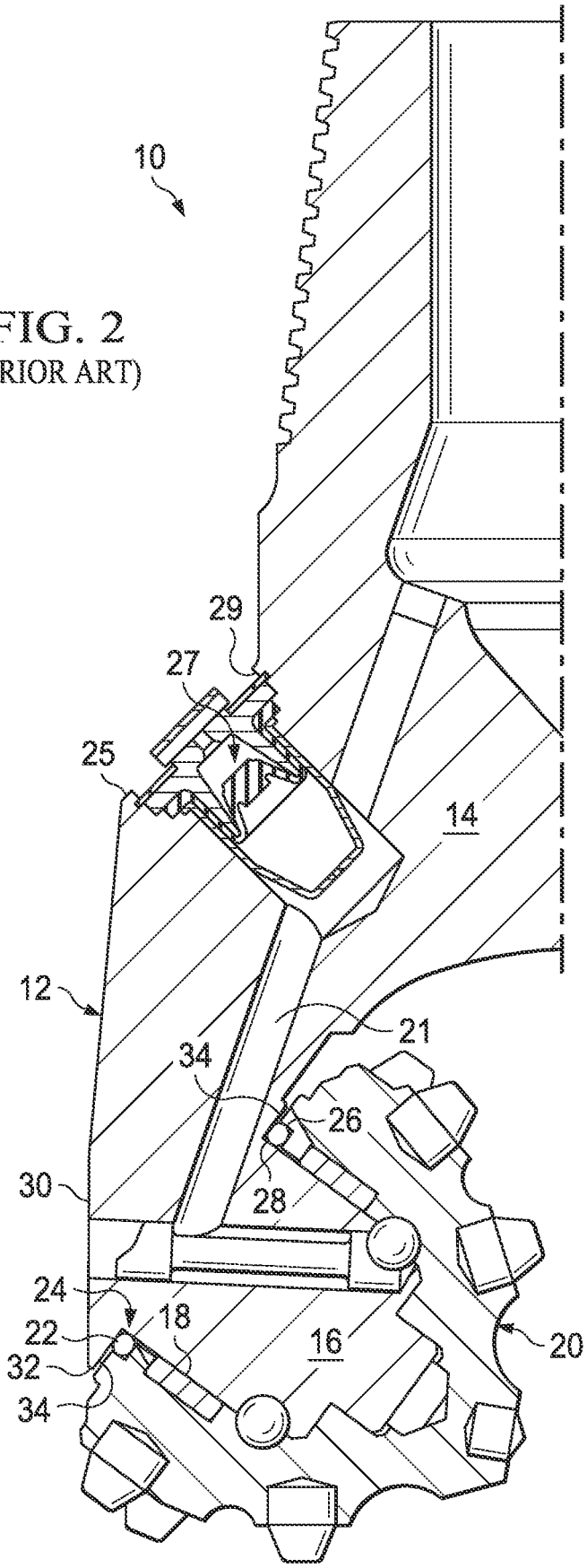
FIG. 2 (PRIOR ART)
FIG. 2 illustrates a cross-sectional view of a portion of a leg of the prior art rotary cone drill bit of FIG. 1.
Figure 3:
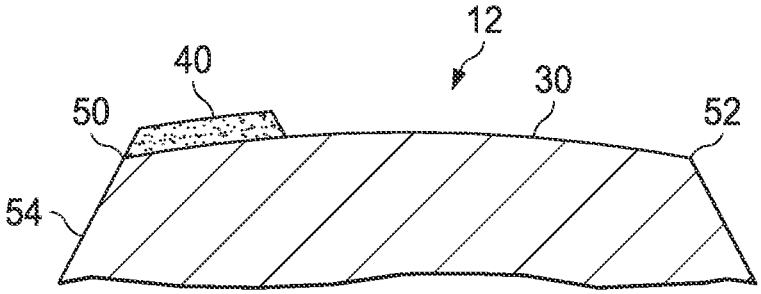
FIG. 3 (PRIOR ART)
FIG. 3 illustrates application of a layer of hardfacing material to a shirttail surface of the leg.
Figure 5A:
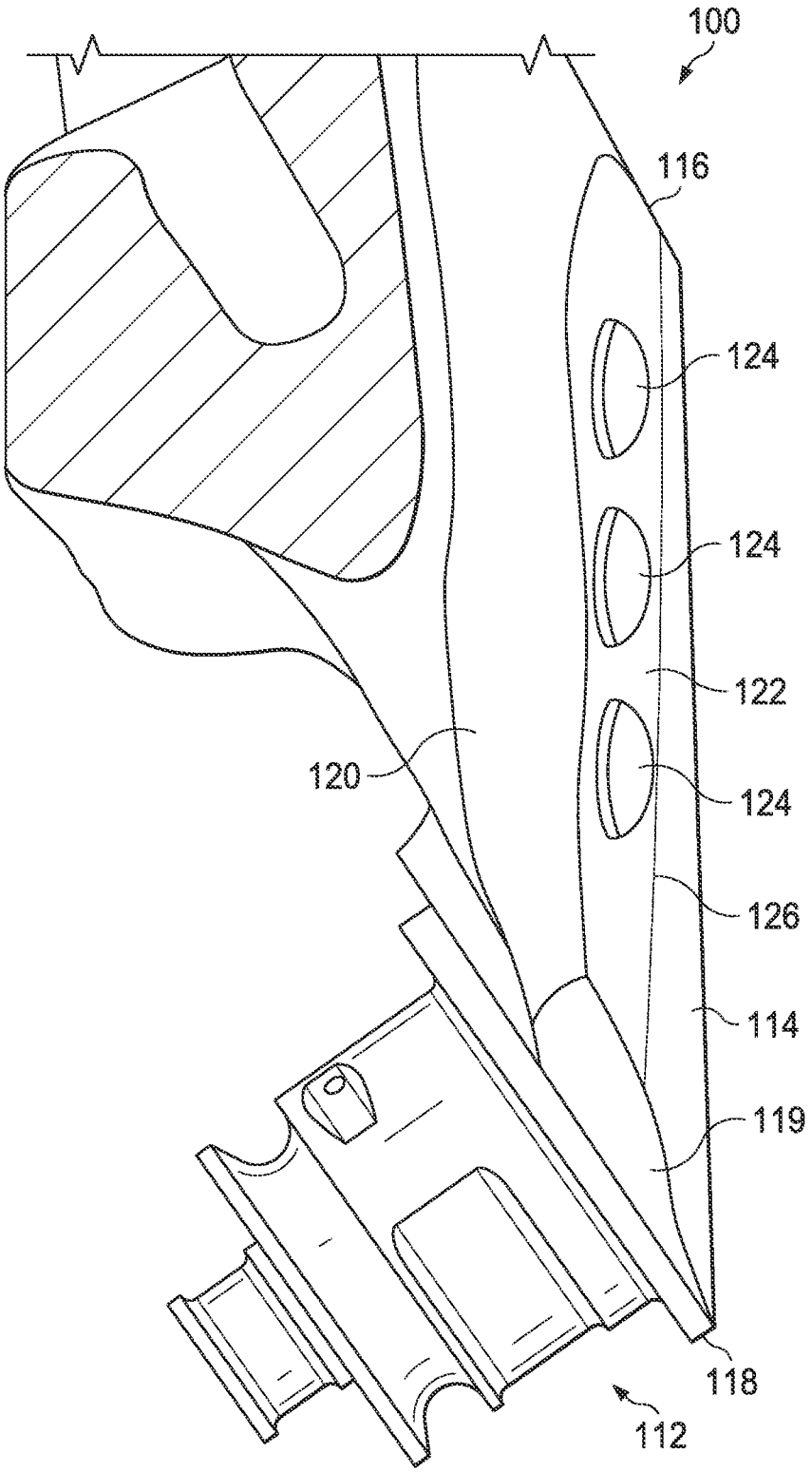
FIG. 5A illustrates an isometric view of a rotary cone drill bit including protection mechanisms for a flat leading transitional surface.
Figure 5B:
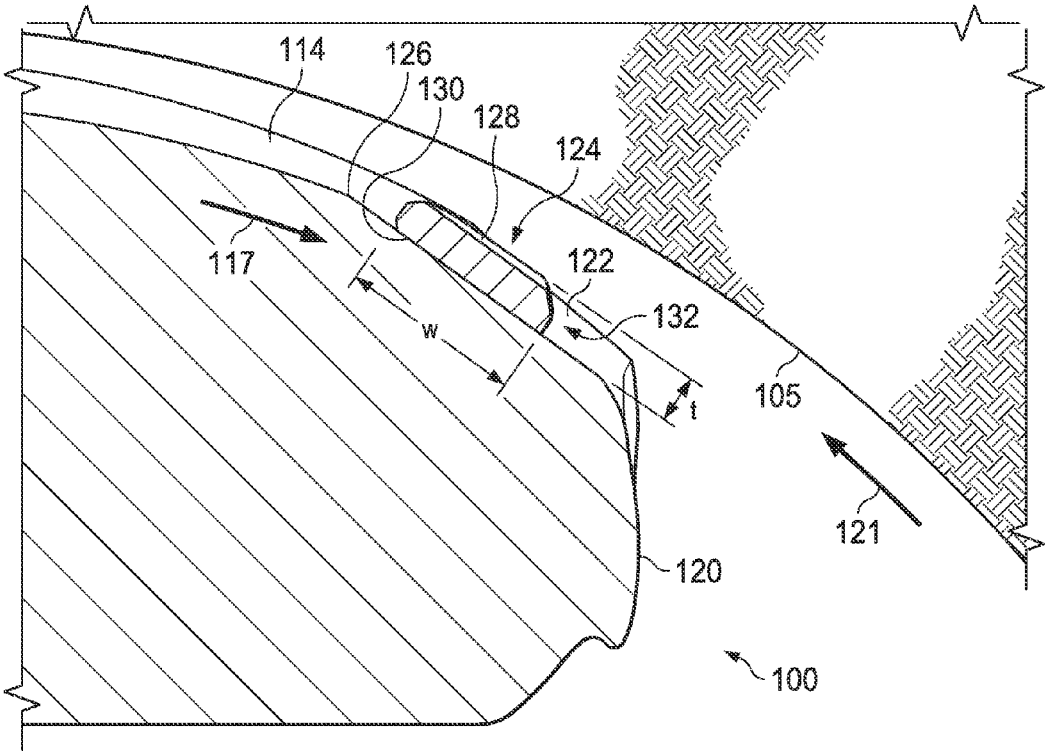
FIG. 5B is an axial cross section of the leg and a hard material plate shown in FIG. 5A.

Reference is now made to FIG. 5A which illustrates an isometric view of a leg 100 of a rotary cone drill bit and FIG. 5B, which illustrates a cross section taken perpendicular to the axis of the leg 100. The leg 100 is part of the head and extends below a vee (not shown) of the head. The vees of three heads are welded together to form a rotary cone drill bit. Each leg 100 supports a bearing shaft 112, on which a rotary cone is mounted (see FIGS. 1 and 2). A shirttail or shirttail surface 114 is delimited at an upper end by a shoulder 116 and at its lower end terminating to a shirttail edge 118, which is curved and may be semicircular in shape.

The shirttail surface 114 is generally near the outer perimeter of the bit (which also may be referred to as the gage), and is a surface of the leg that is closest to the wall 105 of borehole. As such, it is subject to wear as cuttings created by drilling contact the shirttail and other surfaces of the leg, particularly the leading surfaces. Leading surfaces of the leg are defined by a direction of rotation 117 of the bit, which is clockwise as the bit rotates to create the borehole. Thus, FIG. 5A shows the leading side of the leg 100.

Figure 6:
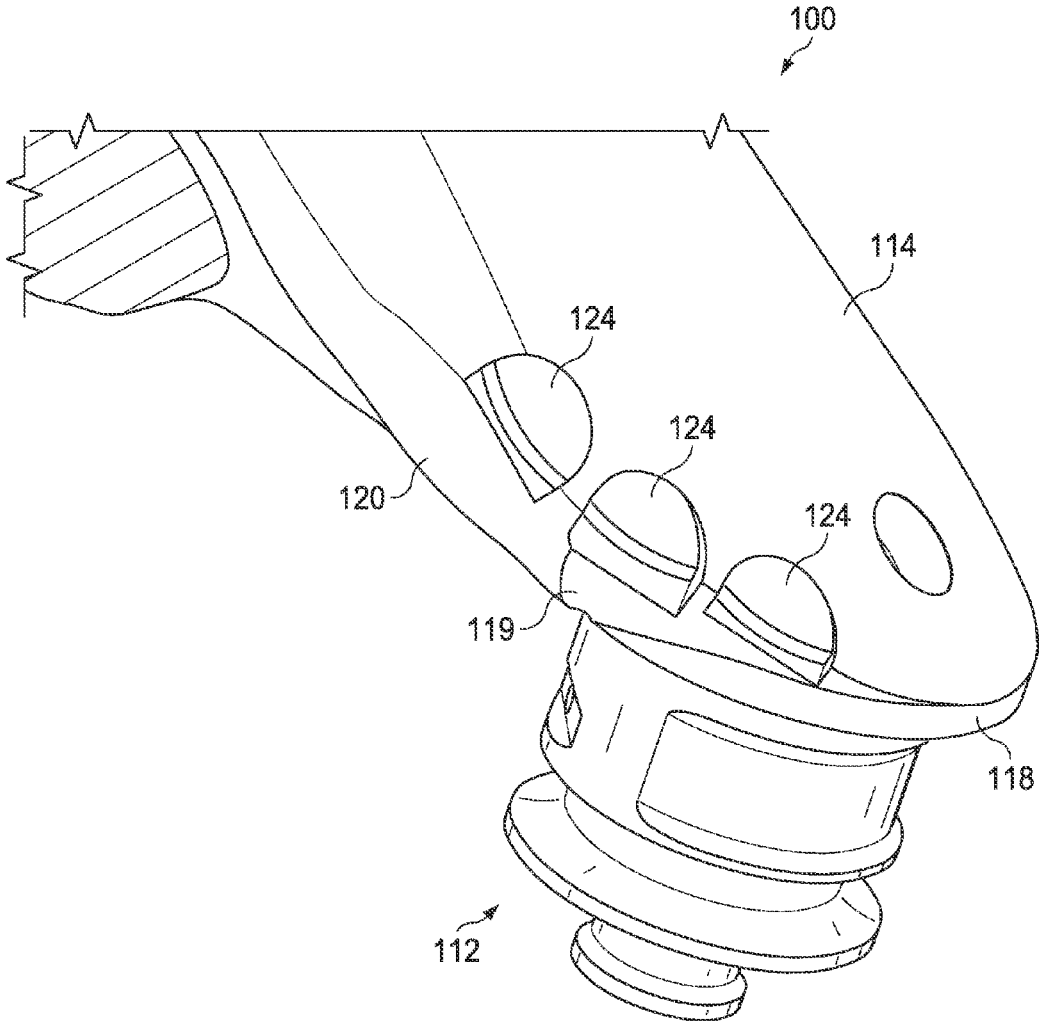
FIG. 6 illustrates an isometric view of a portion of a leg of a rotary cone drill bit including protection mechanisms for a contoured milled surface proximate a shirttail edge.

The shirttail edge 118 is proximate a shirttail contour mill 119 on the leading side of the leg 100. The shirttail contour mill 119 is a surface created by machining away edges to create a smooth surface that follows the profile of the bearing shaft 112. According to embodiments of the present disclosure, one or more hard material plates 124 may be disposed at least partially on the shirttail contour mill 119 to increase the wear resistance of that portion of the leg (see FIG. 6).

The leg also includes a leading side surface 120. This leading side surface 120 is radially internal to the shirttail surface 114 and is not as susceptible to wear from cuttings as the shirttail surface 114. Rather, the leading side surface 120 supports the components, such as the rotary cone, that perform the boring function. Disposed between the leading side surface 120 and the shirttail surface 114 is a leading transitional surface 122. Because the leading transitional surface 122 is radially external to the leading side surface 120, the leading transitional surface 122 is also a wear surface of the leg of the bit.

As such, according to embodiments of the present disclosure, hard material plates 124 are secured either on or in the leading transitional surface 122 to increase its wear resistance due to abrasion caused by cuttings approaching the leading transitional surface 122 from a direction 121 opposite the direction of the bit rotation 117 along with other erosive elements and mechanisms to which an earth boring drill bit is subjected.

In certain embodiments, the leading transitional surface 122 may be a single generally flat surface, as shown in FIG. 5A. In such embodiment, there is an identifiable transitional edge 126 delimiting the leading transitional surface 122, to which the hard material plates 124 are adhered, from the shirttail surface 114. The transitional edge that delimits the shirttail surface 114 and the leading transitional surface 122 may also be referred to as a shirttail edge. A transitional edge may be a fillet or have a radius and still be considered an edge according to embodiments of the present disclosure.

Figure 8A:
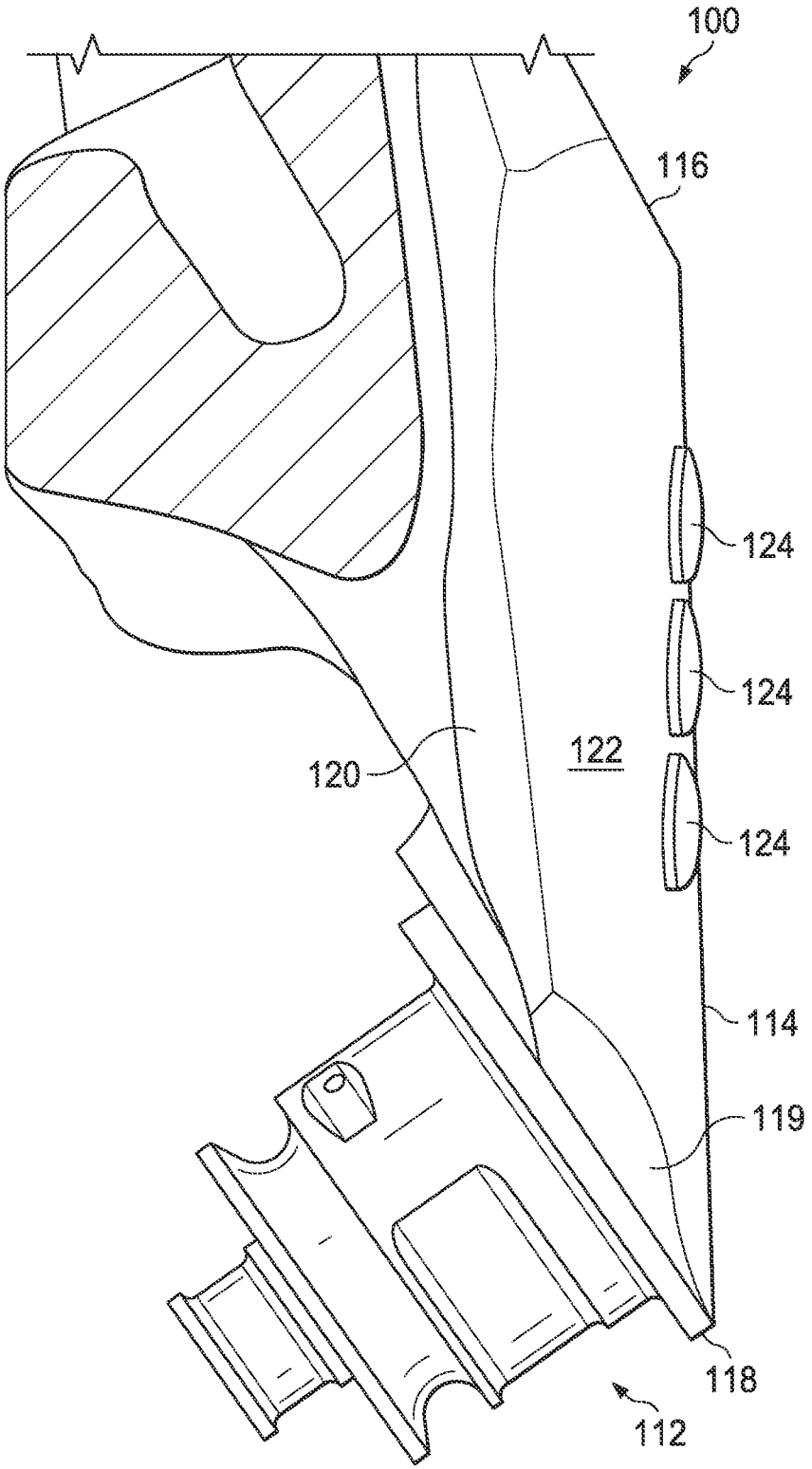
FIG. 8A illustrates an isometric view of a leg of a rotary cone drill bit including protection mechanisms for a curved leading transitional surface without an identifiable edge of a shirttail surface.

In other embodiments, the leading transitional surface 122 may be multiple adjacent flat surfaces. In still other embodiments, the leading transitional surface 122 may be a contoured or rounded surface that generally does not terminate at an edge, but rather makes a smooth transition from the shirttail surface 114 to the leading side surface 120 without the separation of such surfaces being identifiable (see FIGS. 8A and 8B).

In the case of the flat leading transitional surface embodiment, one or more leading transitional edges 126 may be formed where the leading transitional surface 122 meets the shirttail surface 114 (may be referred to as a shirttail edge), where the leading transitional surface 122 meets an adjacent leading transitional surface, and/or where the leading transitional surface meets the leading side surface 120.

In some embodiments, an edge of the hard material plate 124 may be coextensive with one or more of these edges. In other embodiments, the hard material plate 124 may be disposed on one or more leading transitional surfaces where the edge of the hard material plate is offset from a transitional edge such that the edge of the hard material plate is not coextensive with a transitional edge of the leg. In still other embodiments, a slot or counterbore may be formed such that part of the counterbore is formed in the leading transitional surface 122 and part of the counterbore is formed in the shirttail surface 114 (see FIG. 7). In this embodiment, a single hard material plate 124 may be secured to a floor surface within the counterbore and thereby protect two surfaces simultaneously.

The hard material plates 124 increase the wear resistance of the surface or surfaces to which they are secured. The hard material plate 124 is made of a material or combination of materials which are more abrasion resistant than the material used to make the leg 100 and shirttail 114 of the bit. In a preferred implementation, the hard material plate is made of a material such as tungsten carbide, polycrystalline diamond compact (PDC), polycrystalline cubic boron nitride compact impregnated diamond segment, ceramic segment and the like. These materials are superior to the traditional weld on tungsten carbide hardfacing known in the prior art because they are denser and are not as susceptible to abrasion and erosion.

Figure 4:
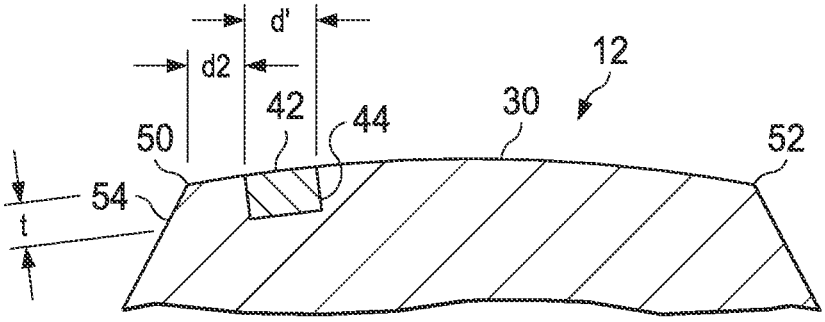
FIG. 4 (PRIOR ART)
FIG. 4 illustrates the use of tungsten carbide inserts press-fit in a shirttail portion of the leg.

The hard material plates 124 have a thickness t and width w (wherein the width is measured in a direction perpendicular to the leading transitional edge 126). The hard material plates 124 are thin plates. In this case, a ratio of the thickness t of the plate to a width w of the plate is less than 0.5 (i.e., $t/w<0.5$). More particularly, the ratio of the thickness t of the plate to the width w of the plate is substantially less than 0.5 (i.e., $t/w<<0.5$). Even more particularly, the ratio of the thickness t of the plate to the width w of the plate is less than 0.2 (i.e., $t/w<0.2$), and may even be less than 0.1 (i.e., $t/w<0.1$). This is permitted because the hard material plates 124 are retained by adhesion to their bottom surface and not by friction forces on their peripheral edges (as is the case with the press-fit inserts used in the prior art (see, FIG. 4)).

Referring to FIG. 5B, each hard material plate 124 includes a top surface 128 and a bottom surface 130. The bottom surface 130 is secured to the bit by brazing or other known methods of adherence, as described below. As such, the geometry or shape of the bottom surface 130 will generally correspond to the surface to which it is adhered. That is, if the hard material plate 124 is secured to a flat surface, such as the milled floor surface of FIG. 7, the bottom surface will be flat. If the hard material plate is secured to a rounded or contoured surface, the bottom surface will correspond to the contour of that surface (see FIGS. 8A and 8B). According to the teachings of the present disclosure, the surfaces of the plate 124 and/or the leading transitional surfaces 122 may include features to enhance adherence, such as a type of surface texturing, including dimpling, cross hatching, knurling, and the like.

The top surface 128 of the hard material plate 124 may be flat or contoured. The shape of the top surface 128 of the hard material plate 124 may be independent of the shape of the surface to which it is secured. However, it may be preferred for optimum wear resistance that the shape of the top surface generally follows the primary contour of the surface to which it is secured. In one embodiment, a flat floor surface may be machined or cast into a contoured leading transitional surface 122. In this case, the bottom surface 130 of the hard material plate 124 will correspond to the machined surface and be flat, while the top surface 128 is contoured to correspond to the rounded leading transitional surface 122. In other embodiments, the hard material plates 124 may be brazed or otherwise adhered, according to the adherence means described below, directly to the leading transitional surface 122 without machining a slot or other recess (see FIGS. 5A and 5B).

Figure 8B:
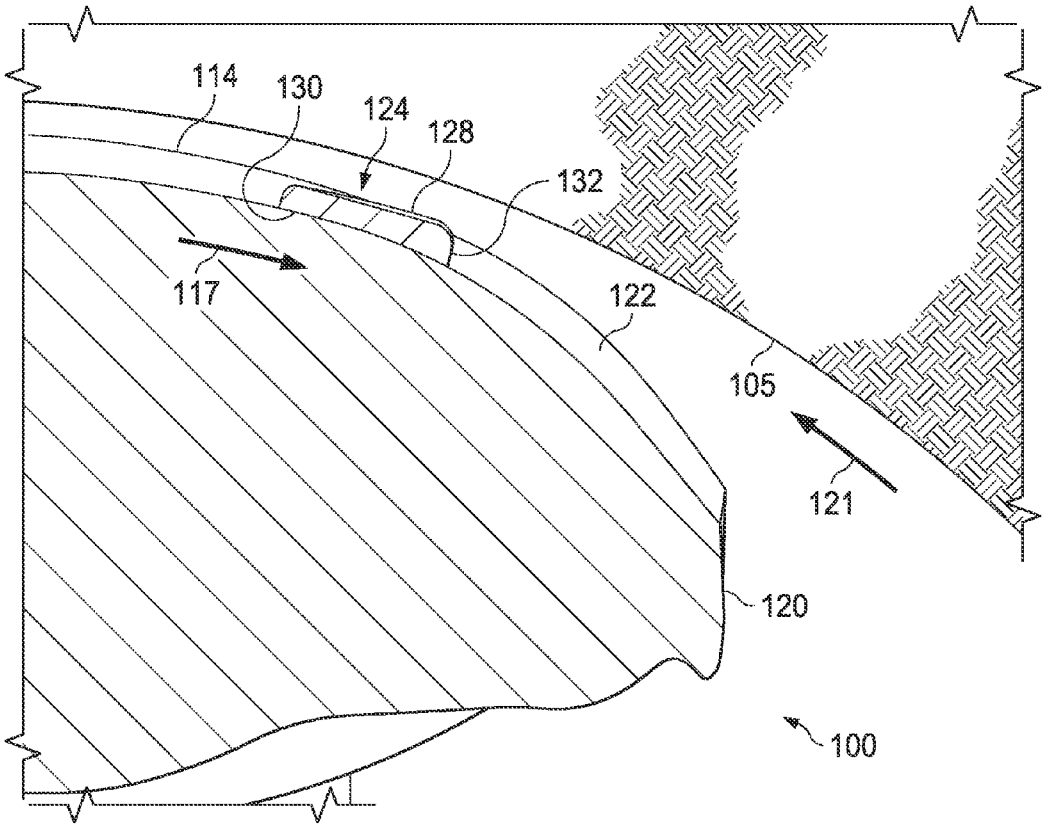
FIG. 8B is an axial cross section of the leg and a hard material plate shown in FIG. 8B disposed on a curved leading transitional surface of a shirttail region without an identifiable edge.
Figure 9:
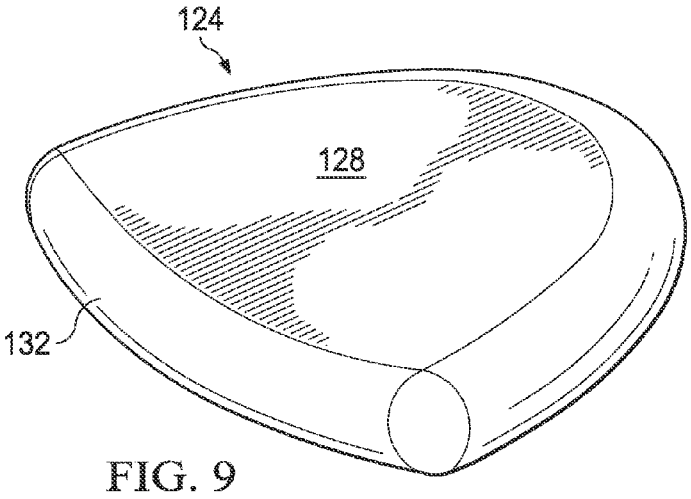
FIG. 9 is an isometric view of a hard material plate with a rounded face according to an embodiment of the present disclosure.

A hard material plate 124 also defines a face 132 on its leading side. In certain embodiments, the face 132 may be beveled as shown in FIG. 5B. In other embodiments, the face 132 may be generally flat, as shown in FIG. 8B. And still in another embodiment, the face 132 may be rounded, as shown in FIG. 9. A rounded face 132, particularly if the plate 124 is secured to a rounded leading transitional surface 122, may allow the plate itself to be more wear resistant.

Figure 7:
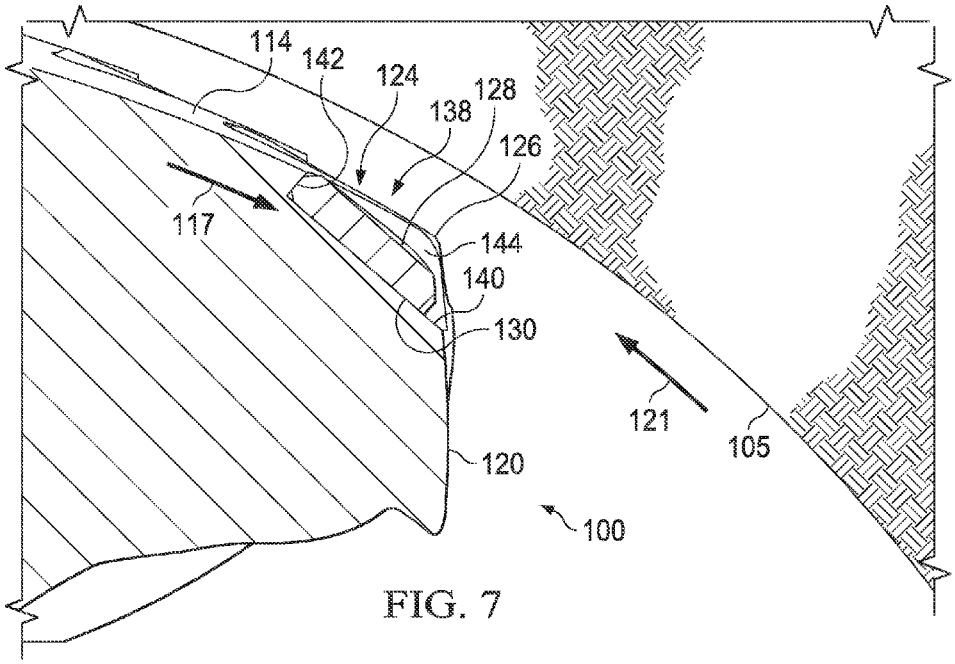
FIG. 7 illustrates an axial cross section of a leg and a hard material plate disposed in a slot formed in a transitional edge of the leg.

Referring now to FIG. 7, a counterbore, countersink, slot, or other recess may be formed in the leg 100 to contain the hard material plate 124. FIG. 7 represents a cross-sectional view of a portion of a leg of a rotary cone drill bit which includes an embodiment of a protection mechanism for the leading transitional surface of the leg 100. The leg 100 is shown in relationship to a wall 105 of a borehole. In this embodiment, a slot 138 is provided in the outer surface of the leg 100 and interrupts a transitional edge 126. The slot 138 may be milled or cast into the outer surface of the leg 100. The slot 138 is defined by a floor surface 140, a rear wall 142 and two side walls 144 (only one side wall is shown in FIG. 7). The hard material plate 124 is adhered within the slot 138.

In a preferred embodiment, a bottom surface 130 of hard material plate 124 is adhered to the floor surface 140 of the slot 138. The means for adhering the bottom surface 130 to the floor surface 140 may, for example, comprise any suitable adhering material which is interposed between the substantially conforming (for example, parallel) surfaces including adhesive material flowable between the substantially conforming surfaces by capillary action such as a brazing material, solder, adhesives, resins, and the like (see, for example, U.S. Patent Application Publication No. 2009/0038442, the disclosure of which is hereby incorporated by reference). Because of drawing scale, the adhesive material is not explicitly shown in the Figures, but it will be understood that the adhesive material is present between the bottom surface 130 and the floor surface 140.

The adhesive material preferably has a substantially uniform thickness between the conforming bottom surface 130 and floor surface 140. In certain embodiments, the hard material plate 124 has a thickness such that when adhered within the slot 138, a top surface 128 of the plate 124 is substantially flush with, or slightly exposed beyond, or slightly recessed below, the outer surface of the leg 100.

According to certain embodiments, the hard material plate may be of substantially uniform thickness, similar to a hockey puck, or its thickness may vary, such that it is more wedge-shaped. Whether the hard material plate is of uniform or variable thickness may be determined by a machined recess or slot in which the hard material plate is secured. A wedge-shaped hard material plate may be adhered to an angled floor surface and serve to prevent the steel of the leg from being undercut from beneath the hard material plate causing the plate to separate from the leg and be lost in the borehole.

Although multiple protection mechanisms are illustrated in the Figures, it will be understood that any one or more of the illustrated protection mechanisms may be selected for use on a leg 100 of a rotary cone drill bit. For example, it will be understood that one slot 138 could instead be provided extending along all or a portion of the leading transitional surface 122, with a single hard plate 124 adhered within the slot 138.

It will be understood that the hard material plates 124 can have any desired shape (including circular shapes, oval shapes, semi-circular shapes, and the like). Furthermore, the plates 124 can be of different sizes, perhaps with size selection depending on placement position.

It will be noted that the slots and plates may be of any selected geometry thus allowing for the application of protection to complex surfaces of the bit. Tiling of the plates edge-to-edge permits the application of protection to be extended continuously over a complex curved surface. Alternatively, a single plate with a complex curved bottom surface could be provided.

The illustration of protection being applied using slots and plates on the leading transitional surface or surfaces is by way of example only, it being understood that the protection mechanisms described can be applied to any surfaces of a leg of the bit that are susceptible to wear.

Although preferred embodiments of the method and apparatus have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. A rotary cone drill bit, comprising:
a body;
a leg depending from the body, wherein the leg includes:
a shirttail surface delimited at an upper end by a shoulder and at a lower end by a curved shirttail edge, and
a shirttail contour mill formed on a leading side of the leg and adjacent to the shirttail edge;
a bearing shaft extending from the leg;
a cone mounted to the bearing shaft;
a preformed hard material plate having a bottom surface; and
an adhesive material attaching the bottom surface of the hard material plate to the leg at least partially on the shirttail contour mill,
wherein a top surface of the hard material plate is substantially flush with the shirttail contour mill.

2. The bit of claim 1 wherein the adhesive material attaching the bottom surface of the hard material plate to the leg comprises a flowable adhesive material interposed between the bottom surface of the hard material plate and the leg.

3. The bit of claim 2 wherein the flowable adhesive material is a brazing material.

4. The bit of claim 1 wherein the hard material plate is disposed in a slot formed in the leg.

5. The bit of claim 1 wherein the hard material plate is one of: a solid tungsten carbide plate, a polycrystalline diamond compact, an impregnated diamond segment, a ceramic segment, or a polycrystalline cubic boron nitride compact.

6. The bit of claim 1 wherein the hard material plate has width w and a generally uniform thickness t, wherein a ratio $t/w<0.5$.

7. The bit of claim 1 wherein:
the hard material plate includes a leading face, and
the leading face includes a beveled surface.

8. The bit of claim 1 wherein:
the hard material plate includes a leading face, and
the leading face is rounded.

9. The bit of claim 1 further comprising:
a second preformed hard material plate having a bottom surface; and
a second adhesive material attaching the bottom surface of the second preformed hard material plate to the leg at least partially on the shirttail contour mill.

10. The bit of claim 9 wherein each preformed hard material plate further has at least one of a semi-circular, circular, and oval shape.

11. The bit of claim 1 wherein:
the leg further includes a leading side surface and a leading transitional surface disposed between the leading side surface and the shirttail surface, and
the bit further comprises:
a second preformed hard material plate having a bottom surface; and
a second adhesive material attaching the bottom surface of the second hard material plate to a substantially conforming surface formed in or by the leading transitional surface.

12. The bit of claim 11 wherein the substantially conforming surface is a floor surface of a slot formed in the leading transitional surface.

13. The bit of claim 11 wherein:
a transitional edge is defined by the intersection of the shirttail surface and the leading transitional surface, and
the substantially conforming surface is a floor surface of a slot disposed to interrupt the transitional edge.

14. The bit of claim 11 wherein the leading transitional surface is a flat surface.

15. The bit of claim 14 wherein the substantially conforming surface is part of the leading transitional surface.

16. The bit of claim 14 wherein the leading transitional surface is disposed adjacent a second flat leading transitional surface.

17. The bit of claim 11 wherein each preformed hard material plate further has at least one of a semi-circular, circular, and oval shape.

18. The bit of claim 1 wherein:
the leg further includes a leading wear surface,
the leading wear surface is curved,
the shirttail surface smoothly transitions into the leading wear surface, and
the bit further comprises:
a second preformed hard material plate having a bottom surface; and
a second adhesive material attaching the bottom surface of the second hard material plate to a substantially conforming surface formed in or by the leading wear surface.

19. The bit of claim 18 wherein each preformed hard material plate further has at least one of a semi-circular, circular, and oval shape.

20. The bit of claim 1 wherein the preformed hard material plate further has at least one of a semi-circular, circular, and oval shape.

21. A rotary cone drill bit, comprising:
a body;
a leg depending from the body, wherein the leg includes:
a shirttail surface delimited at an upper end by a shoulder and at a lower end by a curved shirttail edge, and a shirttail contour mill formed on a leading side of the leg and adjacent to the shirttail edge;

a bearing shaft extending from the leg;

a cone mounted to the bearing shaft;

a preformed hard material plate having a bottom surface and a semi-circular shape; and an adhesive material attaching the bottom surface of the hard material plate to the leg at least partially on the shirttail contour mill.

22. The bit of claim 21, wherein a top surface of the hard material plate is substantially flush with the shirttail contour mill.

* * * * *